US005633223A

United States Patent [19]

Vasudevan et al.

[11] Patent Number: 5,633,223

[45] Date of Patent: May 27, 1997

[54] HEAVY DUTY LIQUID COMPOSITIONS COMPRISING STRUCTURING SOLIDS OF DEFINED DIMENSION AND MORPHOLOGY

[75] Inventors: Tirucherai V. Vasudevan, West Orange; John Gormley, Midland Park, both of N.J.

[73] Assignee: Lever Brothers Company, Division of Conopco, Inc., New York, N.Y.

[21] Appl. No.: 520,797

[22] Filed: Aug. 30, 1995

[51] Int. Cl.[6] ..... C11D 3/37; C11D 3/395

[52] U.S. Cl. ..... 510/303; 510/339; 510/345; 510/361; 510/405; 510/417; 510/418; 510/465

[58] Field of Search ..... 252/95, 135, 174, 252/174.23, 174.24, 174.25, DIG. 14; 510/303, 339, 342, 345, 361, 405, 417, 418, 465

[56] References Cited

U.S. PATENT DOCUMENTS

| | | | |
|---|---|---|---|
| 4,659,497 | 4/1987 | Akred et al. | 252/135 |
| 5,021,195 | 6/1991 | Machin et al. | 252/545 |
| 5,071,586 | 12/1991 | Kaiserman et al. | 252/174.12 |
| 5,073,285 | 12/1991 | Liberati et al. | 252/94 |
| 5,147,576 | 9/1992 | Montague et al. | 252/174 |
| 5,205,957 | 4/1993 | Van de Pas | 252/173 |
| 5,264,142 | 11/1993 | Hessel et al. | 252/95 |
| 5,484,555 | 1/1996 | Schepers et al. | 252/541 |

FOREIGN PATENT DOCUMENTS

| | | |
|---|---|---|
| 0086614 | 8/1983 | European Pat. Off. . |
| 0160342 | 11/1985 | European Pat. Off. . |
| 9108281 | 6/1991 | WIPO . |
| 9109107 | 6/1991 | WIPO . |

*Primary Examiner*—Paul Lieberman
*Assistant Examiner*—Kery A. Fries
*Attorney, Agent, or Firm*—Ronald A. Koatz

[57] ABSTRACT

The present invention relates to heavy duty liquid composition in which solid particle or mixture of solid particles, wherein at least one side of solid has length or width of 3 to 25 microns, helps to suspend particles of much greater size (i.e., up to about 1000 microns) than possible w/o addition of the suspending solid particles.

5 Claims, No Drawings

HEAVY DUTY LIQUID COMPOSITIONS COMPRISING STRUCTURING SOLIDS OF DEFINED DIMENSION AND MORPHOLOGY

FIELD OF THE INVENTION

The present invention relates to heavy duty liquid compositions that comprise a mixture of lamellar droplets, said compositions produced by adding sufficient amounts of surfactants and/or electrolytes, and solid structurants to impart sufficient suspending power to stably incorporate relatively large size particles in the compositions (i.e., duotropic liquids).

BACKGROUND OF THE INVENTION

Structured heavy duty liquids must be able to suspend particles such that these particles do not phase separate (i.e., settle out of solution) and yet they must not be so thick as to effect the pourability of the liquid compositions.

The dual attribute of suspending power and easy pourability in structured or duotropic liquids currently in the art is accomplished by adding sufficient surfactant and/or electrolyte such that the surfactant forms a disperse, lamellar phase. The prior art liquid compositions are capable of suspending only small (<25 μm) particles such as, for example, zeolites.

Duotropic liquids such as those described above are taught for example in U.S. Pat. No. 5,147,576 to Montague et al., WO 91/09107 to Buytenhek et al., EP 0,160,342 A2 to Humphreys et al., EP 0,564,250 A2 to Coope et al. and WO 91/08281 to Foster et al.

The use of solids of the morphology described in the present invention in structured heavy duty liquids is taught in EP 0,086,614 A1 to Akred et al. However, there are significant differences between the solids and the structured liquid composition mentioned in the above specification and those taught in the current specification. These are as follows:

i) the dimension of the solids used by Akred et al. is not critical while that required to structure structured liquids of the present specification is 1 to 25 microns;

ii) the solids of Akred et al. have to form a network (i.e., solids are coordinated with each other rather than being independent) in the structured liquid while those used in the current specification do not form network as evidenced from rheological measurements; structuring by network formation is undesirable since it takes a considerable amount of time to rebuild the network when the structurant is disturbed (for example, during use of the product) and during this rebuilding the solids can settle out time; furthermore, it is extremely difficult to reproduce the network formation which will reflect in inconsistency in quality of the product formed; and iii) the lamellar droplets of the structured liquid used in the current specification are stabilized using a decoupling polymer, while no stabilizing agent is used in Akred et al. Use of decoupling polymer allows incorporation of much higher levels of surfactants into the detergent formulation. Structured liquids containing decoupling polymers are described in Montague et al. (U.S. Pat. No. 5,147,576) hereby incorporated by reference into the subject application.

While lamellar structured compositions possess shear thinning characteristics to provide suspending power for small particles (less than 25 μm) and maintain pourability, they do not possess sufficient shear thinning property to provide adequate suspending power for large particles (i.e., 200 to 1000 microns) such as, for example, encapsulates of bleach catalysts and enzymes,

BRIEF SUMMARY OF THE INVENTION

Applicants have now discovered that by incorporating certain solid particles of defined dimension and morphology, it is possible to enhance the shear thinning properties (i.e., the ability to suspend particle w/o causing a large increase in pour viscosity) of the HDL compositions such that large size particles 200 to 1000 microns (e.g., encapsulates of bleach catalysts and enzymes) may be stably suspended in these compositions while maintaining pourability. Pour viscosity is measured at shear rate of $21S^{-1}$.

More specifically, the composition is directed to heavy duty liquid compositions comprising:

(1) more than about 20% by weight of a surfactant selected from the group consisting of anionics, nonionics, cationics, zwitterionics, amphoterics and mixtures thereof; and (2) a solid particle, added directly or formed in situ, wherein at least one side of the particle (length or width) is from about 3 to 20 microns in size;

said compositions capable of suspending particles from about 200 to 1000 microns in size.

Said compositions also require the presence of a decoupling or deflocculating polymer (e.g., acrylate/polymethacrylate copolymer having molecular weight of about 3,000 to 15,000).

DETAILED DESCRIPTION OF THE INVENTION

In one embodiment, the present invention relates to heavy duty liquid compositions which are lamellar structured (so-called "duotropic" liquids) and which additionally comprise solid particles or mixture of solid particles which are added either directly or formed in situ wherein at least one side of said particle or particles has a length or width of from about 3 to 20μ (microns).

Unexpectedly, applicants have found that addition of solid or mixture of solids having defined morphology to such heavy duty liquid compositions allows the compositions to suspend particles larger than those previously possible to suspend (i.e., 200 to 1000 microns).

More specifically, the invention is a liquid detergent composition comprising:

(1) greater than about 20%, preferably 25% to 80% by weight of one or more surfactants predominantly present as lamellar droplets dispersed in an aqueous medium containing 0.1%, preferably at least 7%, more preferably at least 15% by weight, to 60% by weight electrolyte;

(2) 0.1 to 5% by weight of a deflocculating polymer; and (3) 1% to 25%, preferably 3% to 15% by wt. of a solid particle, added directly or formed in situ, wherein at least one side of the solid has a length or width of from 3 to 20 microns. Preferably, the width of the particle is less than about 1 micron and the length (being no less than 3 microns) is at least 3 times the width, preferably 5 times the width. The larger the length is relative to the width (i.e., the more "needle-like" the solid), the greater is the suspending power which was observed.

These compositions are capable of suspending particles from about 200 to about 1000 microns in size. Of course, it will be understood that the compositions can suspend particles below 200 microns in size if they can suspend large particles. But for smaller particles (<25 μm), the suspension provided by the "needle-like" suspending particles is not required.

Lamellar Compositions

As noted, compositions of the art have used surfactants in the form of lamellar dispersions to support smaller particles (under 25 microns) while retaining adequate pourability (shear thinning).

Lamellar droplets are a particular class of surfactant structures which, inter alia, are already known from a variety of references, e.g. H. A. Barnes, 'Detergents', Ch. 2. in K. Walters (Ed), 'Rheometry: Industrial Applications', J. Wiley & Sons, Letchworth 1980.

Such lamellar dispersions are used to endow properties such as consumer-preferred flow behavior and/or turbid appearance. Many are also capable of suspending particulate solids such as detergency builders or abrasive particles. Examples of such structured liquids without suspended solids are given in U.S. Pat. No. 4,244,840, while examples where solid particles are suspended are disclosed in specifications EP-A-160,342; EP-A-38,101; EP-A-104,452 and also in the aforementioned U.S. Pat. No. 4,244,840. Others are disclosed in European Patent Specification EP-A-151,884, where the lamellar droplet are called 'spherulites'.

The presence of lamellar droplets in a liquid detergent product may be detected by means known to those skilled in the art, for example optical techniques, various rheometrical measurements, X-ray or neutron diffraction, and electron microscopy.

The droplets consists of an onion-like configuration of concentric bi-layers of surfactant molecules, between which is trapped water or electrolyte solution (aqueous phase). Systems in which such droplets are close-packed provide a very desirable combination of physical stability and solid-suspending properties with useful flow properties.

In such liquids, there is a constant balance sought between stability of the liquid (generally, higher volume fraction of the dispersed lamellar phase, i.e., droplets, give better stability), the viscosity of the liquid (i.e., it should be viscous enough to be stable but not so viscous as to be unpourable) and solid-suspending capacity (i.e., volume fraction high enough to provide stability but not so high as to cause unpourable viscosity).

A complicating factor in the relationship between stability and viscosity on the one hand and, on the other, the volume fraction of the lamellar droplets is the degree of flocculation of the droplets. When flocculation occurs between the lamellar droplets at a given volume fraction, the viscosity of the corresponding product will increase owing to the formation of a network throughout the liquid. Flocculation may also lead to instability because deformation of the lamellar droplets, owing to flocculation, will make their packing more efficient. Consequently, more lamellar droplets will be required for stabilization by the space-filling mechanism, which will again lead to a further increase of the viscosity.

The volume fraction of droplets is increased by increasing the surfactant concentration and flocculation between the lamellar droplets occurs when a certain threshold value of the electrolyte concentration is crossed at a given level of surfactant (and fixed ratio between any different surfactant components). Thus, in practice, the effects referred to above mean that there is a limit to the amounts of surfactant and electrolyte which can be incorporated while still having an acceptable product. In principle, higher surfactant levels are required for increased detergency (cleaning performance). Increased electrolyte levels can also be used for better detergency, or are sometimes sought for secondary benefits such as building.

pH-Jump HDL

A sub-class of lamellar dispersions included in the liquid detergent compositions, or HDLs, relevant to this invention are pH-jump HDLs. A pH-jump HDL is a liquid detergent composition containing a system of components designed to adjust the pH of the wash liquor. It is well known that organic peroxyacid bleaches are most stable at low pH (3–7), whereas they are most effective as bleaches in moderately alkaline pH (7.5–9) solution. Peroxyacids such as 1,2-diperoxy dodecanedionic acid DPDA cannot be feasibly incorporated into a conventional alkaline heavy duty liquid because of chemical instability. Other peroxyacids which can be used include, but not limited to, phthalimidoperhexanoic acid (PAP) and N,N'-terephthaloyl-di-6-amino percaproic acid (TPCAP). To achieve the required pH regimes, a pH jump system can be employed in this invention to keep the pH of the product low for peracid stability yet allow it to become moderately high in the wash for bleaching and detergency efficacy. One such system is borax $10H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galactitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Bleach component is used in the pH jump composition in an amount from about 0.5 to 10.0% by weight of the composition, preferably 1 to 5% by weight.

Electrolytes

As used herein, the term electrolyte means any ionic water-soluble material. However, in lamellar dispersions, not all the electrolyte is necessarily dissolved but may be suspended as particles of solid because the total electrolyte concentration of the liquid is higher than the solubility limit of the electrolyte. Mixtures of electrolytes also may be used, with one or more of the electrolytes being in the dissolved aqueous phase and one or more being substantially only in the suspended solid phase. Two or more electrolytes may also be distributed approximately proportionally, between these two phases. In part, this may depend on processing, e.g the order of addition of components. On the other hand, the term 'salts' includes all organic and inorganic materials which may be included, other than surfactants and water, whether or not they are ionic, and this term encompasses the sub-set of the electrolytes (water-soluble materials).

The compositions of the invention contain electrolyte in an amount sufficient to bring about structuring of the detergent surfactant material. Preferably though, the compositions contain from 0.1% to 60%, more preferably from 7 to 45%, most preferably from 15% to 30% of a salting-out electrolyte. Salting-out electrolyte has the meaning ascribed to in specification EP-A-79646. Optionally, some salting-in electrolyte (as defined in the latter specification) may also be included, provided if of a kind and in an amount compatible with the other components and the compositions is still in accordance with the definition of the invention claimed herein.

Surfactants

A very wide variation in surfactant types and levels is possible. The selection of surfactant types and their proportions, in order to obtain a stable liquid with the required structure will be fully within the capability of those skilled in the art. However, it can be mentioned that an important sub-class of useful compositions is those where the detergent surfactant material comprises blends of different surfactant types. Typical blends useful for fabric washing compositions include those where the primary surfactant(s) comprise nonionic and/or a non-alkoxylated anionic and/or an alkoxylated anionic surfactant.

The total detergent surfactant material in the present invention is present at from greater than 15% to about 80% by weight of the total composition, preferably from greater than 20% to 50% by weight.

In the case of blends of surfactants, the precise proportions of each component which will result in such stability and viscosity will depend on the type(s) and amount(s) of the electrolytes, as is the case with conventional structured liquids.

In the widest definition the detergent surfactant material in general, may comprise one or more surfactants, and may be selected from anionic, cationic, nonionic, zwitterionic and amphoteric species, and (provided mutually compatible) mixtures thereof. For example, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, Munchen & Wien, 1981.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide, either alone or with propylene oxide. Specific nonionic detergent compounds are alkyl ($C_6$–$C_{18}$) primary or secondary, linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phosphine oxides and dialkyl sulphoxides.

Other suitable nonionics which may be used include aldobionamides such as are taught in U.S. Ser. No. 981,737 to Au et al. and polyhydroxyamides such as are taught in U.S. Pat. No. 5,312,954 to Letton et al. Both of these references are hereby incorporated by reference into the subject application.

Suitable anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$ ) alcohols produced, for example, from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulfuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and Cl2 and then hydrolyzing with a base to produce a random sulphonate; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkyl benzene sulphonates and sodium ($C_{10}$–$C_{18}$) alkyl sulphates.

It is also possible to include an alkali metal soap of a long chain mono- or dicarboxylic acid for example one having 12 to 18 carbon atoms at low levels, for example less than 2% by weight of the composition. Higher levels of unsaturated fatty acid soaps, such as oleic acid and salts thereof, for example, would impart an undesirable odor and reduce the foam level of the composition Polymer The polymer of the invention is one which, as noted above, has previously been used in structured (i.e., lamellar) compositions such as those described in U.S. Pat. No. 5,147,576 to Montague et al., hereby incorporated by reference into the subject application. This is because the polymer allows the incorporation of greater amounts of surfactants and/or electrolytes than would otherwise be compatible with the need for a stable, low-viscosity product as well as the incorporation, if desired, of greater amounts of other ingredients to which lamellar dispersions are highly stability-sensitive.

The hydrophilic backbone generally is a linear, branched or highly cross-linked molecular composition containing one or more types of relatively hydrophobic monomer units where monomers preferably are sufficiently soluble to form at least a 1% by weight solution when dissolved in water. The only limitations to the structure of the hydrophilic backbone are that they be suitable for incorporation in an active-structured aqueous liquid composition and that a polymer corresponding to the hydrophilic backbone made from the backbone monomeric constituents is relatively water soluble (solubility in water at ambient temperature and at pH of 3.0 to 12.5 is preferably more than 1 g/l). The hydrophilic backbone is also preferably predominantly linear, e.g., the main chain of backbone constitutes at least 50% by weight, preferably more than 75%, most preferably more than 90% by weight.

The hydrophilic backbone is composed of monomer units selected from a variety of units available for polymer preparation and linked by any chemical links including $$-O-,\ -\overset{\overset{\displaystyle O}{\|}}{C}-O,\ -C-C-,\ -C-O-,\ -\overset{\overset{\displaystyle O}{\|}}{C}-N,\ -C-N,$$

and $$-\overset{\overset{\displaystyle O}{\|}}{\underset{\underset{\displaystyle OH}{|}}{P}}-$$

Preferably the hydrophobic side chains are part of a monomer unit which is incorporated in the polymer by copolymerizing hydrophobic monomers and the hydrophilic monomer making up the backbone. The hydrophobic side chains preferably include those which when isolated from their linkage are relatively water insoluble, i.e., preferably less than 1 g/l, more preferred less than 0.5 g/l, most preferred less than 0.1 g/l of the hydrophobic monomers, will dissolve in water at ambient temperature at pH of 3.0 to 12.5.

Preferably, the hydrophobic moieties are selected from siloxanes, saturated and unsaturated alkyl chains, e.g., having from 5 to 24 carbons, preferably 6 to 18, most preferred 8 to 16 carbons, and are optionally bonded to hydrophilic backbone via an alkoxylene or polyalkoxylene linkage, for example a polyethoxy, polypropoxy, or butyloxy (or mixtures of the same) linkage having from 1 to 50 alkoxylene groups. Alternatively, the hydrophobic side chain can be composed of relatively hydrophobic alkoxy groups, for example, butylene oxide and/or propylene oxide, in the absence of alkyl or alkenyl groups.

Monomer units which made up the hydrophilic backbone include:

(1) unsaturated, preferably mono-unsaturated, $C_{1-6}$ acids, ethers, alcohols, aldehydes, ketones or esters such as monomers of acrylic acid, methacrylic acid, maleic acid, vinyl-methyl ether, vinyl sulphonate or vinylalcohol obtained by hydrolysis of vinyl acetate, acrolein;

(2) cyclic units, unsaturated or comprising other groups capable of forming inter-monomer linkages, such as saccharides and glucosides, alkoxy units and maleic anhydride;

(3) glycerol or other saturated polyalcohols.

Monomeric units comprising both the hydrophilic backbone and hydrophobic side chain may be substituted with groups such as amino, amine, amide, sulphonate, sulphate, phosphonate, phosphate, hydroxy, carboxyl and oxide groups.

The hydrophilic backbone is preferably composed of one or two monomer units but may contain three or more different types. The backbone may also contain small amounts of relatively hydrophilic units such as those derived from polymers having a solubility of less than 1 g/l in water provided the overall solubility of the polymer meets the requirements discussed above. Examples include polyvinyl acetate or polymethyl methacrylate.

The level of deflocculating polymer in the present invention is 0.1% to 20% by weight, preferably 0.5% to 5% by weight, most preferably 1% to 3% by weight.

The compositions of Montague et al., however, even with deflocculating polymer, have poor solids suspending ability. This is evidenced by applicants visual observation of instability when particles in the size range of 200 to 1000 microns, with a density that differed from the liquid density by 0.2 to 0.3 specific gravity units, were placed in such liquids.

In Applicants copending U.S. Ser. No. 08/402,675 to Garcia et al., applicants used a substantially linear, water soluble, highly salt tolerant, non-adsorbing ionic polymer to increase suspending power. The solids of the invention, as discussed below, are completely different materials for enhancing particle suspension.

Solid Particle

The solid particle of the invention is any solid meeting the morphological characteristics defining the invention. That is, the solid or mixture of solids may be any solid added or formed in situ from the salt, wherein at least one side of the solid has a length or width of from about 3 to 20 microns, preferably 3 to 15 microns, more preferably 3 to 10 microns, i.e., about the same size as that of the lamellar drops. While not wishing to be bound by theory, it is believed that the particles should be about the same size as the lamellar droplets but not much larger because, if they are too large, the composition may more readily phase separate.

Preferably the width of the particle is less than 1 micron and the length, being at least 3 microns in size, is at least three times, preferably at least 5 to 20 times the width. As noted, the length of the particle may be from about 3 to 25 microns. Again, in principle the length may be longer as long as it is not so long as to sediment. Indeed, the more "needle-like" the particle, the better it is believed to be for purposes of the invention (i.e., enhanced suspending while not increasing the pour viscosity).

The particle can be any particle meeting the required ratio of one side to another and having at least one side 3 to 20 microns while maintaining those physical characteristics (i.e., dimensions and morphology) in the formulation. Example of particles with the dimensions which have been used are calcium citrate, and TPCAP (N,N'-tetraphthaloyl-di-6-aminocaproic peracid). Examples of salts used to precipitate in-Situ the needle shaped particles of defined dimension and morphology are gypsum (calcium sulfate dihydrate), calcium chloride and strontium chloride. Other examples of particles of this dimension and morphology, may be found in the CRC Handbook of Physics and Chemistry.

The particles are added or formed in-situ varying in the range from 1 to 25 percent, preferably 3 to 15 percent by weight of the composition.

Other Ingredients

Preferably the amount of water in the composition is from 5 to 75%, more preferred from 20 to 60% by wt.

Some or all of the electrolyte (whether salting-in or salting-out), or any substantially water-insoluble salt which may be present, may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in UK patent specification GB 1,302,543.

Examples of organic detergency builders, when present, include the alkaline metal, ammonium and substituted ammonium polyacetates, carboxylates, polycarboxylates, polyacetyl carboxylates, carboxymethyl oxysuccinates, carboxymethyloxymalonates, ethylene diamine-N,N, disuccinic acid salts, polyepoxysuccinates, oxydiacetates, triethylene tetramine hexacetic acid salts, N-alkyl imino diacetates or dipropionates, alpha sulpho-fatty acid salts, dipicolinic acid salts, oxidized polysaccharides, polyhydroxysulphonates and mixtures thereof.

Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid, tartrate mono succinate and tartrate di-succinate.

Although it is possible to incorporate minor amounts of hydrotropes such as lower alcohols (e.g., ethanol) or alkanolamines (e.g., triethanolamine), in order to ensure integrity of the lamellar dispersion we prefer that the compositions of the present invention are substantially free from hydrotropes. By hydrotrope is meant any water soluble agent which tends to enhance the solubility of surfactants in aqueous solution.

Apart from the ingredients already mentioned, a number of optional ingredients may also be present, for example lather boosters such as alkanolamides, particularly the monoethanolamides derived from palm kernel fatty acids and coconut fatty acids, fabric softeners such as clays, amines and amine oxides, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and usually present in very minor amounts, fluorescent agents, perfumes, enzymes such as proteases, amylases and lipases (including Lipolase (Trade Mark) ex Novo), germicides and colorants.

The following examples are intended to be for illustrative purposes only and are not intended to limit the claims in any way.

Materials

Surfactants: Linear alkylbenzenesulfonic acid (LAS acid) and Neodol 25-9 (alcohol ethoxylate; $C_{12-15}$ $EO_9$) were of commercial grade and were supplied by Vista Chemicals and Shell Chemicals respectively.

polymer: Decoupling polymer (Narlex DC1) was obtained from National Starch and Chemicals. The polymer was an acrylate/lauryl methacrylate copolymer having MW of 3800 Daltons.

Inorganic Reagents: Sodium citrate dihydrate used was of analytical reagent grade and was purchased from Aldrich Chemicals. 50 weight percent sodium hydroxide of analytical reagent grade was supplied by Fisher Scientific Company. Magnesium chloride, calcium chloride, and barium chloride were purchased from Fisher Scientific Company.

Other reagents: Milli Q water was used in all the formulations and for reagent dilution.

Solids: Gypsum (calcium sulfate dihydrate) was purchased from Mallinkrodt and TPCAP from Solvay-Interox and calcium citrate tetrahydrate from Pfaltz and Bauer.

Unless stated otherwise all percentages, in the examples are in the specification are percentages by weight.

EXAMPLES

Model Formulation

The following composition was prepared by first adding sodium citrate to water. After dissolution of sodium citrate, that is after the solution became visibly clear, 50% solution of sodium hydroxide was added followed by the structuring solids (or salts), the decoupling polymer (Narlex DC-1) and the detergent surfactants (premix of LAS acid and Neodol 25-9) in that sequence. The composition was continuously stirred and maintained at 55° C. during the additions. After completion of surfactants addition, stirring was continued for 30 minutes after which the formulation was cooled down to room temperature.

| Formulation Composition | |
|---|---|
| Component | Parts |
| Linear Alkyl Benzene Sulfonic (LAS) acid | 21.0–31.5 |
| Neodol 25-9 | 9.0–13.5 |
| Total surfactants | 30.0–45.0 |
| NaOH (50% solution) | 5.3–8.0 |
| Na-citrate $2H_2O$ | 14.2–18.4 |
| Structuring solids or salts | 0–8.0 |
| Narlex DC-1 (33% solution) | 4.5 |
| Deionized water | up to 100 parts |

These ratios were maintained constant in various formulations:

LAS acid/50% NaOH=4.0

LAS acid/Neodol 25.9=2.33 pH-Jump Formulation

The following composition, to be referred to as "pH jump formulation", was prepared by first adding sodium citrate and sodium borate to water. After dissolution of citrate and borate, that is after the solution became visibly clear, desired amount of a 70 wt.% aqueous solution of sorbitol was added followed by 50% solution of sodium hydroxide, structuring solids (or salts) ethylenediamine tetraacetic acid (EDTA), the fluorescer, the decoupling polymer (Narlex DC-1) and the detergent surfactants (premix of LAS acid and Neodol 25-9) in that sequence. The composition was continuously stirred and maintained at 55° C. during the additions. After completion of surfactants addition, stirring was continued to 30 minutes after which the formulation was cooled down to the room temperature (≈25° C). Required amount of a 30 weight percent slurry of peracid bleach (TPCAP, N,N'-tetraphthaloyl-di-6-aminocaproic peracid) was then added to the formulation and the stirring continued until the particles were homogeneously dispersed, that is until no clumps of the wet cake were seen.

| Formulation Composition | | |
|---|---|---|
| | Parts | |
| Component | Composition A (High active) | Composition B (Low active) |
| LAS acid | 22.7 | 15.4 |
| Neodol 25-9 | 10.4 | 6.6 |
| Total surfactants | 33.1 | 22.0 |
| 50% NaOH | 5.7 | 3.7 |
| Na-citrate $2H_2O$ | 10.0 | 7.5 |
| Sodium sulfate | — | — |
| Borax 5 $H_2O$ | 3.2 | 2.0 |
| Sorbitol (70 wt. % solution) | 13.7 | 8.7 |
| Gypsum | 0–8.0 | 0–8.0 |
| TPCAP (30% slurry) | 0–15 | 0–8.0 |
| Narlex DC-1 (33% solution) | 3–4.5 | 3–4.5 |
| Fluorescer | 0.2 | — |
| EDTA | 0–0.9 | 0–0.9 |
| Deionized water | up to 100 parts | |

Example 1

Comparative

Effect of solids of platelet morphology on the rheological properties of the model formulation.

| Solid | | Platelet Dimension, | Viscosity, Pas | | Viscosity |
|---|---|---|---|---|---|
| Type | Wt. % | μm | @ 0.2 Pa | @ 21 $s^{-1}$ | Ratio** |
| None | — | — | 0.9 | 0.27 | 3.4 |
| Bentonite | 4.0 | ≈0.3 × 0.3* | 11.9 | 1.66 | 7.2 |
| TPCAP | 4.5 | ~4 × 4 | 26.8 | 0.92 | 29.1 |

*From "An Introduction to Clay Colloid Chemistry" by H. van Olphen, Wiley Interscience, Chap. 1, 1977.

**Viscosity ratio = $\frac{\text{Viscosity at 0.2 Pa}}{\text{Viscosity at } 21S^{-1}}$ 0.2 Pa represents the stress exerted by a particle of 1000 μm in size, with a density difference between the particle and the suspending medium of 0.12 gm/cm 3. This represents a typical enzyme capsule that is used in bleach containing liquids. $21S^{-1}$ represents shear rate during pouring. The viscosity at 0.2 Pa should be as high as possible to suspend the particles for a very long time while the viscosity at $21S^{-1}$ should be as low as possible to make the liquid easily pourable. Therefore, ideally viscosity ratio should be as high as possible.

This example shows that addition of solid of platelet morphology does improve the viscosity ratio, a measure of shear thinning. However, the dimension of the particle has a significant effect. While bentonite has only a marginal effect with respect to enhancement of the viscosity ratio, the effect of TPCAP is significant. It is to be noted that the dimension of the TPCAP platelet is similar to that of lamellar droplets. The average median size of the lamellar droplet in the formulations described in all the examples vary in the range of 3 to 8 microns (Spherical diameter).

Example 2

Comparative

Effect of specific solids of needle shape on the rheological properties of the model formulation.

| Solids | | Needle Dimension, | Viscosity, Pas | | Viscosity |
|---|---|---|---|---|---|
| Type | Wt. % | μm | @ 0.2 Pa | @ 21 $s^{-1}$ | Ratio |
| None | — | — | 0.91 | 0.27 | 3.4 |
| Attapulgite | 4.0 to 8.0 | ≈1 × 0.1* | Unstable formulation - viscosity not measured | | |
| Calcium citrate | 7.5 | ≈5.5 × 1.0 | 7660 | 2.0 | 3830 |
| TPCAP | 4.2 | ≈10 × 1.0 | 5451 | 1.11 | 4910 |
| Glass fiber** | 5.0 | ≈50 × 5.0 | 2.0 | 0.59 | 3.4 |

*From "An Introduction to Clay Colloid Chemistry" by H. van Olphen, Wiley Interscience, Chap. 1, 1977.

**Higher concentrations (75%) of glass fiber tend to convert the formulation into an unpourable paste.

This example shows that addition of solids of needle morphology improve the viscosity ratio (a measure of shear thinning) only in the case of calcium citrate and TPCAP. Although attapulgite is a needle shaped particle, it destabilizes the formulation while glass fiber does not show any significant effect. Again it is to be emphasized here that calcium citrate and TPCAP has dimensions similar to that of lamellar droplets (3 to 8 microns), whereas attapulgite has smaller dimensions. Also, TPCAP has a larger effect on shear thinning than calcium citrate even at a lower concentration level by weight. Due to the difference in the density of TPCAP (density ≈1.4 g/cc) compared to that of calcium citrate (density—2.3–2.4 g/cc), the lower level by weight of TPCAP is equivalent to the higher level by weight of calcium citrate in terms of their level by volume. That is, 7.5 percent calcium citrate tetrahydrate and 4.2 percent TPCAP by weight both amount to about 3 percent by volume of solids. Thus, the higher viscosity ratio obtained for TPCAP is due to its higher ratio of length to width (10×1.0 μm) compared to that for calcium citrate tetrahydrate (5×1.0 μm).

Example 3

Effect of different salts on the rheological properties of the model formulation.

| Salt | | Precipitated Solid (needle) | | Viscosity, Pas | | Viscosity |
|---|---|---|---|---|---|---|
| Type | Wt. % | Type | Dimension μm | @ 0.2 Pa | @ 21 $s^{-1}$ | Ratio |
| None | — | None | — | 0.91 | 0.27 | 3.4 |
| $MgCl_2.6H_2O$ | 5.0 | None | — | 0.74 | 0.31 | 2.4 |
| $CaCl_2.2H_2O$ | 3.0 | Calcium citrate | ≈3.0 × 1.0* | 175.3 | 0.92 | 190.0 |
| $SrCl_2.6H_2O$ | 4.6 | Strontium citrate | ≈7.5 × 1.5* | 101.0 | 0.70 | 145.0 |
| $BaCl_2$ | 0.75 | Barium citrate | >1 mm long fibers | Formulation is a paste and not a pourable liquid | | |
| Gypsum | 4.0 | Calcium citrate | ≈3 × 1.0* | 311.0 | 1.00 | 311.0 |

*Addition of $CaCl_2$, $SrCl_2$ and gypsum caused precipitation of needle shaped particles of calcium citrate in the case of $CaCl_2$. Addition of $BaCl_2$, on the other hand, resulted in precipitation of solids that were more than 1 mm long.

This example shows that addition of salts results in a significant increase of viscosity ratio (a measure of shear thinning) only in the case of salts that cause precipitation of needle shaped particles of dimensions similar to that of lamellar droplets (3 to 8 microns). This example thus shows that the presence of needle shaped particles of dimensions similar to that of lamellar droplets cause enhanced shear thinning (viscosity ratio), no matter whether or not it is added externally, as in the case of calcium citrate and TPCAP, or formed in-situ in the formulation by addition of appropriate salts to the formulation. It is to be noted here that 3.0 percent $CaCl_2.2H_2O$ and 4.0 percent gypsum by weight cause in-situ precipitation of 10 percent and 11.5 percent by weight of calcium citrate tetrahydrate. However, the viscosity ratios obtained in these two cases (145 and 311 ), are lower than that obtained with 7.5 percent by weight of externally added calcium citrate tetrahydrate (viscosity ratio=3830; Example 2). The calcium citrate tetrahydrate precipitated in-situ by addition of $CaCl_2.2H_2O$ and gypsum has a lower ratio of length by width (3×1.0 μm) compared to that of externally added calcium citrate tetrahydrate (length by width=5.5×1.0 μm) and this can account for the higher viscosity ratio obtained with the latter.

Example 4

Effect of calcium citrate concentration on the rheological properties of the model formulation.

| Calcium Citrate | Viscosity, Pas | | |
|---|---|---|---|
| Wt. % | @ 0.2 Pa | @ 21 $s^{-1}$ | Viscosity Ratio |
| 0.0 | 0.91 | 0.27 | 3.4 |
| 4.0 | 8.0 | 0.59 | 6.2 |
| 5.0 | 30.0 | 0.87 | 47.1 |
| 7.5 | 7660 | 2.0 | 3830 |

This example shows that a critical concentration of calcium citrate is needed to obtain a high viscosity ratio. In other words, the increase in viscosity ratio with calcium citrate concentration is not gradual. However, as will be shown in a latter example the critical concentration depends on the surfactants level in the formulation.

It should be noted that, although only 7.5% calcium citrate is added (versus the equivalent of 11% formed in situ when 3% calcium chloride or 4% gypsum is added as in Example 3), the large difference is viscosity ratio (3830 versus 190 or 311) is probably due to the fact that the calcium citrate is more "needle-like", i.e., has dimension of 5.5 to 1 versus 3.0 to 1.

Example 5

Effect of gypsum concentration on the rheological properties of the formulation.

| Gypsum | Viscosity, Pas | | |
|---|---|---|---|
| Wt. % | @ 0.2 Pa | @ 21 $s^{-1}$ | Viscosity Ratio |
| 0.0 | 0.91 | 0.27 | 3.4 |
| 2.5 | 0.86 | 0.41 | 2.1 |
| 3.0 | 31.1 | 0.65 | 47.8 |
| 4.0 | 311.0 | 1.00 | 311.0 |

This example also shows that a critical concentration of gypsum is needed to obtain a high viscosity ratio. As will be shown in a later example, the critical concentration depends on the surfactants level in the formulation. It should be noted in this case addition of gypsum cause precipitation of needle shaped particles of calcium citrate, which is the structuring solid.

Example 6

Mutual effect of surfactant and gypsum concentrations on the rheological properties of the formulation.

| Surfactant | Gypsum | Viscosity, Pas | | |
|---|---|---|---|---|
| Wt. % | Wt. % | @ 0.2 Pa | @ 21 $s^{-1}$ | Viscosity Ratio |
| 25.0 | 4.0 | 0.18 | 0.05 | 3.6 |
| 25.0 | 8.0 | 93.0 | 0.30 | 312.0 |
| 37.5 | 4.0 | 311.0 | 1.00 | 311.0 |

This example also shows that amount of solids needed to obtain highly shear thinning liquids depend on the surfactant concentration. The structuring solids in this case is needle shaped particles of calcium citrate, which precipitates due to the addition of gypsum to the formulation, of dimensions similar to that of lamellar droplets.

Example 7

Effect of gypsum in pH-jump high active (Composition A) formulation.

| Gypsum Wt. % | Viscosity, Pas | | |
|---|---|---|---|
| Wt. % | @ 0.2 Pa | @ 21 $s^{-1}$ | Viscosity Ratio |
| *0.0 | 11.4 | 0.8 | 14.3 |
| 3.0 | 1210 | 0.92 | 1315 |
| 4.0 | 1700 | 1.4 | 1214 |

*It should be noted that the composition contains 14.0 wt. % TPCAP platelets. However, as seen, the TPCAP platelets do not significantly increase viscosity ratio.

This example shows that addition of gypsum, which results in precipitation of calcium citrate needles, increases the viscosity ratio also in the high active pH jump formulation.

Example 8

Effect of gypsum in pH-jump low active (Composition B) formulation.

| Gypsum Wt. % | Viscosity, Pas | | |
|---|---|---|---|
| Wt. % | @ 0.2 Pa | @ 21 $s^{-1}$ | Viscosity Ratio |
| 0.0 | Unstable formulation | | |
| 4.0 | $1.93 \times 10^4$ | 2.45 | 7878 |
| 8.0 | $1 \times 10^5$ | 2.8 | 35714 |

This example shows that gypsum addition increases the viscosity ratio even in the low active pH jump formulation. Furthermore, low active pH jump formulation is not stable without gypsum addition.

Example 9

Stability of large size particles in lamellar liquids with structuring needle-shaped particles versus lamellar liquids without its structuring needle-shaped particles 500–1000 micron size enzyme capsules were suspended in a duotropic liquid (with and without structuring particles of invention) with a density difference of about 0.05 to 0.15 specific gravity units and results were as follows:

| | Suspending Medium | Visual Observation |
|---|---|---|
| I. | Model formulation A with no needle-shaped sides (37.5 wt % total surfactants) | Capsule separation occurred overnight (~16 hrs.) |
| II. | Model formulation A with 4 wt. % added gypsum (37.5 wt. % total surfactants) | No capsule separation even after 12 months |
| III. | pH-jump (high active) formulation B with 14 wt. % of 30 wt. % slurry of TPCAP platelets | Capsule separation occurred overnight (~16 hrs.) |

This example clearly shows that lamellar structurant, duotropic liquid alone is not sufficient to suspend large size particles such as enzyme capsules. Only when the structuring particles of invention are added can the large size particle (e.g., 500–1000 microns) be suspended.

Thus, in formulations I (not pH-jump) and III (pH-jump) where no structuring particles were added, capsule separation occurred within 16 hours.

By contrast, when the suspending particles of the invention were added (formulation II), no separation was seen even after 12 months.

We claim:

1. A structured heavy duty liquid composition comprising:

(a) more than about 20% by wt. of a surfactant selected from the group consisting of anionics, nonionics, cationics, zwitterionics, amphoterics and mixtures thereof;

(b) 1 to 25% by wt. of a solid particle wherein said particle or particles is selected from the group consisting of calcium citrate, calcium chloride, strontium chloride, gypsum, and N,N'-terephthaloyl-di-6-aminocaproic peracid and mixtures thereof or mixture of solid particles added directly or formed in situ, wherein the length of the solid particle or particles is from about 3 to 25 microns and is at least 3 times to 20 times the width of the particle or particles;

(c) 0.1–60% by wt. electrolyte; and (d) 0.1–5% by wt. deflocculating polymer wherein said deflocculating polymer is a copolymer of acrylate and lauryl methacrylate;

wherein said compositions are capable of suspending solid particles up to about 1000 microns in size.

2. A heavy duty liquid according to claim 1, wherein the width of the solid particle is less than about 1 micron and the length of solid is at least 3 times the width and no less than about 3 microns.

3. A heavy duty liquid according to claim 2, wherein the width of the solid is less than about 1 micron and the length of the solid is at least 5 times the width.

4. A composition according to claim 1, capable of suspending particles 200 to 1000μ in size.

5. A structured heavy duty liquid composition comprising:

(a) more than about 20% by wt. of a surfactant selected from the group consisting of anionics, nonionics, cationics, zwitterionics, amphoterics and mixtures thereof;

(b) 1 to 25% by wt. of a solid particle or mixture of solid particles added directly or formed in situ, wherein the length of the solid particle or particles is from about 3 to 25 microns and is at least 3 times to 20 times the width of the particle or particles wherein said particle or particles is selected from the group consisting of calcium citrate, calcium chloride, strontium chloride, gypsum, and N,N'-terephthaloyl-di-6-aminocaproic peracid and mixtures thereof;

(c) 0.1–60% by wt. electrolyte;

(d) 0.1–5% by wt. deflocculating polymer wherein said polymer is a coploymer of acrylate and lauryl methacrylate;

(e) 1–25% by wt. of an alcohol selected from the group consisting of sorbitol, catechol, galacticol, fructose and pinacol;

(f) 0.5 to 10.0% by wt. borate or boron component; and (g) 0.5–10.0% by wt. bleach component;

wherein said compositions are capable of suspending solid particles up to about 1000μ in size.

* * * * *